United States Patent [19]

Suzuki et al.

[11] Patent Number: 4,755,234

[45] Date of Patent: Jul. 5, 1988

[54] METHOD OF MANUFACTURING PRESSURE VESSEL STEEL WITH HIGH STRENGTH AND TOUGHNESS

[75] Inventors: Haruo Suzuki, Tokyo; Toshio Takano, Yokohama; Koshiro Tsukada, Yokohama; Hiroaki Tsukamoto, Yokohama, all of Japan

[73] Assignee: Nippon Kokan Kabushiki Kaisha, Tokyo, Japan

[21] Appl. No.: 56,264

[22] Filed: May 26, 1987

Related U.S. Application Data

[63] Continuation of Ser. No. 762,964, Aug. 6, 1985, abandoned.

[30] Foreign Application Priority Data

Aug. 9, 1984 [JP] Japan ..... 59-165580

[51] Int. Cl.[4] ..... C21D 8/00

[52] U.S. Cl. ..... 148/12 F; 148/12.4

[58] Field of Search ..... 148/12 F, 2, 12.1, 12.4, 148/143; 25/124

[56] References Cited

U.S. PATENT DOCUMENTS

| | | | |
|---|---|---|---|
| 4,325,748 | 4/1982 | Nashiwa et al. | 148/12 F |
| 4,381,940 | 5/1983 | Watanabe et al. | 75/12.4 |
| 4,394,184 | 7/1983 | Ohtani et al. | 148/12 F |
| 4,406,711 | 9/1983 | Nagumo et al. | 148/12 F |
| 4,572,748 | 2/1986 | Suga et al. | 148/12 F |

FOREIGN PATENT DOCUMENTS

| | | | |
|---|---|---|---|
| 0041323 | 3/1982 | Japan | 148/12 F |

*Primary Examiner*—L. Dewayne Rutledge
*Assistant Examiner*—S. Kastler
*Attorney, Agent, or Firm*—Frishauf, Holtz, Goodman & Woodward

[57] ABSTRACT

A method of manufacturing pressure vessel steel having high strength and high toughness comprising the steps of heating steel to a temperature higher than 1200° C., said steel containing from 0.03 to 0.12 wt. % C, 0.10 to 0.8 wt. % Si, 0.45 to 1.00 wt. % Mn, 0.80 to 3.50 wt. % Cr, 0.10 to 1.60 wt. % Mo, 0.10 to 0.53 wt. % Ni, 0.010 to 0.040 wt. % soluble aluminum, at least one of 0.05 to 0.40 wt. % V and 0.02 to 0.20 wt. % Nb, less than 0.010 wt. % Ti, 0.0002 to 0.0010 wt. % B, and less than 0.004 wt. % N, the balance of iron and impurities, the N and Ti satisfying the following equation $$N < 14/48 \times Ti + 0.0024\%;$$

rolling the heated steel at a temperature above 1050° C. to obtain a total reduction of more than 30%; directly quenching the rolled steel; and tempering the rolled steel.

8 Claims, 1 Drawing Sheet

METHOD OF MANUFACTURING PRESSURE VESSEL STEEL WITH HIGH STRENGTH AND TOUGHNESS

This is a continuation of application Ser. No. 762,964, filed Aug. 6, 1985 and now abandoned.

BACKGROUND OF THE INVENTION

This invention relates to a method of manufacturing low carbon pressure vessel steel having a high strength and a high toughness with high resistance to hydrogen attack and overlay disbonding, and high weldability.

Cr-Mo steels for petroleum refining reactors such as 1¼Cr-½Mo to 3Cr-1Mo, are required to have high strength at elevated temperatures since higher operation temperature and pressure are required for improving the refining efficiency. To improve the strength, it has been the practice to enhance the hardenability by B treatment or to incorporate carbon and alloying elements to the upper limit of the specification. It has also been proposed to improve the strength by incorporating such micro-alloying elements as V, Nb, Ti, etc. However, in spite of these methods, it is still difficult to satisfy the elevated temperature allowable stress defined in ASME Sec. VIII, Div. 1 or 2 in the case of heavy section plates, as it is necessary to use long term post weld heat treatment (PWHT). Furthermore, an increase in C content strongly decreases resistance to hydrogen attack and overlay-disbonding. For those steels to which micro-alloying elements are added, higher heating temperature in hot working, normalizing or quenching are necessary than for the ordinary steels because of low solubility of carbo-nitrides of these micro-alloying elements. But although high temperature heat treatment is effective to increase the strength, toughness decreases greatly due to coarse austenitic grain size caused by high temperature heat treatment. Thus, for pressure vessel steels for elevated temperatures, especially those used in a hydrogen environment, higher temperature heat treatment described above is not feasible from the point of safety design.

SUMMARY OF THE INVENTION

The object of this invention is to provide a method of manufacturing Cr-Mo steels having a high strength and high toughness with excellent resistance to hydrogen attack and overlay-disbonding and also good weldability.

The method comprises the steps of:

preparing steel containing 0.03~0.12 wt.% of C, 0.10~0.8 wt.% of Si, 0.45~1.00 wt.% of Mn, 0.80~3.50 wt.% of Cr, 0.10~1.60 wt.% of Mo, 0.10~0.53 wt.% of Ni, 0.010~0.040 wt.% of soluble aluminum, either one or both of 0.05~0.40 wt.% of V and 0.02~0.20 wt.% of Nb, less than 0.010 wt.% of Ti, 0.0002~0.0010 wt.% of B, and less than 0.004 wt.% of N, the balance of iron and impurities wherein quantities of N and Ti satisfy the following relation $$N < 14/48 \times Ti + 0.0024\%;$$

heating the steel at a temperature higher than 1200° C.;

rolling the heated steel at a total reduction of higher than 30% at a temperature above 1050° C.;

directly quenching the rolled steel; and tempering (post weld heat treating) the steel.

The steel of this invention is first characterized by a balance between Ti and N contents satisfying the following relations $$N < 0.29 \text{ wt.\% of } Ti + 0.24 \text{ wt.\%}$$

$$Ti < 0.01 \text{ wt.\%}$$

$$N < 0.0040 \text{ wt.\%}$$

In this modification very small amount of Ti(<0.01%) is added to fix free N and to form fine precipitation of TiN, which can sufficiently manifest the effect of hardenability of free B without impairing toughness as in the case of coarse precipitation of TiN. The second characterization of this invention is a method of direct-quenching. The steel is heated to a temperature higher than 1200° C. leading to sufficient dissolution of V, Nb, etc. into the matrix. Then the steel is rolled at a total reduction of more than 30% at a temperature of higher than 1050° C. and fine recrystallized austenitic grains can be obtained.

Accordingly, when the rolled steel is quenched directly and tempered, the strength is improved greatly by fine precipitation of carbonitrides of micro alloying elements without impairing toughness.

DESCRIPTION OF THE PREFERRED EMBODIMENTS

Figure 1:
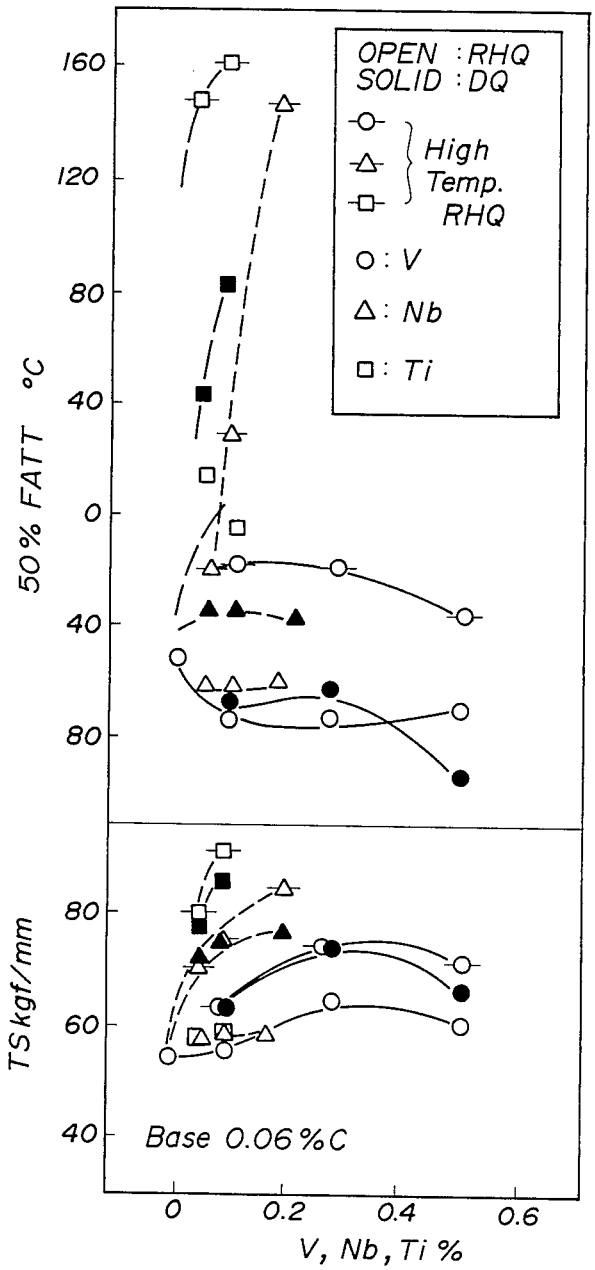
FIG. 1 characterized the high tensile strength and toughness of direct-quenched 2¼Cr-1Mo steel containing 0.06 wt.% of C, 0.5 wt% of Ni, 0.007 wt% of Ti, 0.0008 wt% of B, 0.003 wt% of N and V, Nb or Ti.

For the purpose of improving strength of Cr-Mo steels without impairing toughness, resistance to hydrogen attack and overlay disbonding, and weldability, we have investigated the influence of the alloying elements upon the strength and toughness of the direct-quenched Cr-Mo steels. As a consequence, we have found that the strength can be greatly improved without impairing the toughness by subjecting Cr-Mo steels of a specific composition to direct quenching under specific conditions.

Based on such discovery, the invention provides a method of manufacturing low carbon Cr-Mo steels having excellent elevated temperature strength, a high toughness, high resistance to hydrogen attack and overlay-disbonding and good weldability.

First of all, the balance of Ti, B and N content characterize the steel of this invention. Titanium is incorporated particularly for fixing free N which lowers the hardening effect of free B by precipitating as BN. However, when N content is more than 0.004 wt.%, incorporation of Ti of more than 0.01 wt% greatly decreases the toughness as described below. In a case of a large steel ingot having a weight of larger than 30 tons, which is commonly used for pressure vessels, the cooling speed at the time of solidification becomes low, and hence coarse TiN form at the central portion of the ingot, thereby decreasing the toughness. Thus, in order to obtain high strength and toughness the quantities of Ti and N should be Ti<0.01% and N<0.004%.

We have noted that the hardenability caused by B greatly depends upon the quantity of free N and that when the quantity of free N is less than 0.0024% the hardenability caused by B can be fully manifested and thus the strength and toughness are improved greatly.

Therefore, in the range of N<0.0040% and Ti<0.010% as above mentioned, when N and Ti in steel satisfies the relationship:

$$N < 14/48 \times Ti(\%) + 0.0024$$

the hardening effect of B can be fully manifested.

We have also recognized that where N is fixed by Ti, etc., where B is incorporated in an amount higher than 0.0002%, the hardenability can be improved, whereas when it is incorporated in excess of 0.0010%, the hardenability and hot workability are degraded. For this reason, the range of B was determined to be 0.0002~0.0010%.

A purpose of direct quenching is to effectively dissolve V, Nb and other elements, which are difficult to bring into solid solution at an ordinary normalizing operation or a hot working temperature (950° C.), by heating the slab to a temperature more than 1200° C. and then rolling at a total reduction of more than 30% at a temperature higher than 1050° C. to form fine grain structure of recrystalized austenite, thereby improving the strength and the toughness after quenching and tempering.

It should be understood that, in this invention it is not always necessary to terminate the rolling at a temperature higher than 1050° C. More particularly, so long as a sufficiently large total reduction is effected to form fine recrystallized austenite structure, the advantageous effects of this invention can be realized even when the rolling is made at a lower temperature. However, when rolling is effected at a temperature lower than the $Ar_3$ point, the toughness and hardness after direct quenching is decreased so that the finishing temperature must be higher than the $Ar_3$ point.

The effect of direct quenching and the addition of V, Nb or Ti are shown in FIG. 1 on 2¼Cr-1Mo steel having a basic composition of 0.06% of C, 0.5% of Ni, 0.007% of Ti, 0.0008% of B and 0.003% of N. When the steel with V modification was subjected to the direct quenching (corresponding to a thickness of 130 mm) the tensile strength was increased by more than 20 kg/mm$^2$. In other words, it will be clear than even in a low carbon steel containing 0.06% of C, the strength can be increased greatly without impairing the toughness as would occur in the prior art steel.

Niobium has substantially the same effect as V, thus greatly increasing the strength when subjected to the direct quenching. Ti also improves the strength greatly, but toughness is impaired significantly. This shows that incorporation of Ti in an amount more than that necessary for fixing free N is not advantageous.

In a case of reheat-quenching (corresponding to RHQ, 130 mm) from a high temperature of 1250° C., substantially the same strength can be obtained, but the toughness degrades greatly because the $\gamma$ grain becomes large at the time of high temperature reheating.

With the direct quenching technique, the carbon content of Cr-Mo pressure vessel steels can be reduced without decreasing the strength and toughness. The low carbon Cr-Mo steel manufactured with the method of this invention also has an excellent resistance to hydrogen attack and overlay disbonding and good weldability.

The reason for setting various components in specific ranges will now be described.

From the standpoint of resistance to hydrogen attack, overlay disbonding and weldability, it is desirable to limit the C content to be less than 0.12%, but from the standpoint of ensuring hardenability and elevated temperature strength more than 0.03% C is necessary. For this reason, the amount of C was determined to be 0.03~0.12%.

Because of the low carbon content, the amount of Ni should be higher than 0.1% for the purpose of ensuring hardenability. However, when more than 0.53% of Ni is incorporated, susceptibility to temper embrittlement of the steel increases so that the range of Ni was set to be 0.1%~0.53%.

From the standpoint of strength and resistance to oxidation, more than 0.10% of Si is necessary. However, when it is incorporated in excess of 0.8%, not only the toughness decreases but also susceptibility to temper embrittlement and hydrogen embrittlement increases. For this reason, the quantity of Si was determined to be 0.10%~0.80%.

Although Mn improves the strength and toughness, it increases temper embrittlement susceptibility, so that the range of Mn was selected to be 0.45~1.00%.

V and Nb form fine and stable carbides by tempering process which improve the elevated temperature strength, creep rupture strength and resistance to hydrogen attack. For this reason, it is necessary to add V in an amount more than 0.05% and Nb in an amount more than 0.02%. However, when V and Nb are excessive, the toughness and weldability are impaired. Consequently, it is necessary to set 0.40% for the upper limit of V, and 0.20% for the upper limit of Nb.

Although the addition of aluminum is necessary to make fine $\gamma$ grains, and to enhance hardening effect of B by decreasing dissolved N through AN precipitation, an excess addition of soluble aluminum, degrades the creep strength and resistance to hydrogen attack. For this reason the range of the soluble aluminum was selected to be 0.010~0.040%.

For the purpose of ensuring toughness, it is desirable to control the quantities of impurity elements P and S to be P≦0.015% and S≦0.007%.

Examples of the method of manufacturing steel of this invention will be described in the following together with control examples. The chemical compositions of the steel of this invention and prior art steel are shown in the following Table I in which samples A through E are steels of this invention and F through H are conventional steels.

TABLE I (unit: Weight %)

| | Steel | | C | Si | Mn | P | S | Ni | Cr | Mo | V | Nb | Ti | B | sol. Al | Total N |
|---|---|---|---|---|---|---|---|---|---|---|---|---|---|---|---|---|
| This invention | A | 3Cr—1Mo | 0.10 | 0.12 | 0.50 | 0.005 | 0.001 | 0.21 | 3.02 | 0.99 | 0.32 | — | 0.008 | 0.0007 | 0.012 | 0.0035 |
| | B | 2¼Cr—1Mo | 0.09 | 0.15 | 0.58 | 0.006 | 0.002 | 0.53 | 2.41 | 1.03 | 0.29 | — | 0.009 | 0.0009 | 0.014 | 0.0024 |
| | C | " | 0.08 | 0.18 | 0.56 | 0.005 | 0.001 | 0.48 | 2.45 | 1.01 | 0.35 | — | 0.009 | 0.0007 | 0.018 | 0.0037 |
| | D | " | 0.06 | 0.20 | 0.53 | 0.004 | 0.001 | 0.50 | 2.38 | 0.98 | 0.28 | 0.02 | 0.007 | 0.0006 | 0.010 | 0.0040 |
| | E | 1¼Cr—½Mo | 0.08 | 0.64 | 0.12 | 0.007 | 0.002 | 0.33 | 1.36 | 0.56 | 0.20 | — | 0.008 | 0.0008 | 0.013 | 0.0036 |
| Prior art | F | 3Cr—1Mo | 0.13 | 0.27 | 0.55 | 0.005 | 0.001 | — | 3.19 | 1.03 | — | — | — | — | 0.010 | 0.0034 |

TABLE I-continued

| Steel | | C | Si | Mn | P | S | Ni | Cr | Mo | V | Nb | Ti | B | sol. Al | Total N |
|---|---|---|---|---|---|---|---|---|---|---|---|---|---|---|---|
| | | | | | | | | | | | | | | (unit: Weight %) | |
| G | 2¼Cr—1Mo | 0.15 | 0.11 | 0.57 | 0.006 | 0.003 | — | 2.44 | 1.04 | — | — | — | — | 0.011 | 0.0043 |
| H | 1¼Cr—½Mo | 0.15 | 0.64 | 0.64 | 0.005 | 0.001 | — | 1.44 | 0.61 | — | — | — | — | 0.017 | 0.0030 |

The hot rolling conditions of respective samples shown in Table I are shown in Table II in which samples A~E are subjected to the direct quenching according to this invention.

TABLE II

| Steel | | Position | Plate thickness (mm) | Heat* treatment | Heating temperature (°C.) | Amount of reduction at temp. higher than 1050° C. | Finishing temp. of rolling (°C.) | T.P × $10^3$** |
|---|---|---|---|---|---|---|---|---|
| This invention | A | Center | 300 | DQ | 1280 | 40% | 1050 | 20.8 |
| | B | of plate | 250 | " | 1250 | 50% | 1000 | 20.8 |
| | C | thickness | 200 | " | 1270 | 60% | 1030 | 20.8 |
| | D | ½t | 100 | " | 1250 | 60% | 1050 | 20.6 |
| | E | | 150 | " | 1280 | 60% | 1040 | 20.0 |
| Prior art steel | F. | Center | 300 | RHQ | 930 | — | — | 20.8 |
| | G | of plate | 200 | " | 920 | — | — | 20.8 |
| | H | thickness ½t | 150 | " | 930 | — | — | 20.0 |

*DQ, RHQ } - Temper - PWHT

**T.P: Tempering parameter, T (log. t + 20)
T: Heating temp. K.° (°C. +273) at tempering and/or PWHT
t: Heating time at tempering and/or PWHT The mechanical properties of respective samples were measured and shown in the following Table III.

TABLE III

| Steel | Tensile strength (at room temp.) Ps (kg/mm²) | Ts (kg/mm²) | El (%) | RA (%) | Tensile strength at 500° C. Ps (kg/mm²) | Ts (kg/mm²) | El (%) | RA (%) | Creep rupture strength σT ($10^4$ h) at 500° C. (kg/mm²) | Charpy vT5 (°C.) | vE0 (kg · m) |
|---|---|---|---|---|---|---|---|---|---|---|---|
| A | 58.5 | 68.4 | 26.3 | 79 | 45.3 | 50.1 | 19.7 | 80 | 26.0 | −46 | 32.4 |
| B | 57.8 | 67.0 | 28.7 | 80 | 44.1 | 49.2 | 19.5 | 81 | 25.0 | −45 | 34.1 |
| C | 56.4 | 65.8 | 29.5 | 80 | 44.0 | 48.6 | 20.7 | 81 | 24.5 | −56 | 33.7 |
| D | 58.9 | 68.6 | 30.1 | 81 | 45.7 | 50.9 | 21.1 | 80 | 26.5 | −63 | 32.6 |
| E | 59.5 | 69.5 | 28.6 | 82 | 46.2 | 51.7 | 21.6 | 82 | 34.0 | −59 | 31.8 |
| F | 43.9 | 60.1 | 31.5 | 77 | 34.4 | 41.6 | 25.8 | 86 | 18.5 | −55 | 27.2 |
| G | 40.9 | 56.7 | 33.0 | 78 | 35.1 | 41.2 | 24.1 | 83 | 18.5 | −63 | 29.1 |
| H | 50.4 | 65.7 | 28.0 | 74 | 37.6 | 45.7 | 23.3 | 84 | 30.0 | −39 | 24.3 |

Remark: RA shows reduction of area.

These Tables show that in the steels of this invention of any composition of 1¼Cr-½Mo~3Cr-1Mo, the room temperature and elevated temperature strength, creep rupture strength and toughness are higher than those of prior art samples F~H. The resistance to hydrogen attack and overlay disbonding, and weldability of the steel of this invention have been improved over those of prior art steel.

For the reason described above, the low carbon steel of this steel is suitable for the use of pressure vessels.

What is claimed is:

1. A method of manufacturing Cr-Mo pressure vessel steel having high strength and high toughness comprising the steps of heating Cr-Mo steel to a temperature higher than 1200° C., said Cr-Mo steel containing from 0.03 to 0.12 wt.% C, 0.10 to 0.8 wt.% Si, 0.45 to 1.00 wt.% Mn, 0.80 to 3.50 wt.% Cr, 0.4 to 1.60 wt.% Mo, with said Cr and said Mo being associated such that when said Cr is about 0.8% to about 1.8%, said Mo is about 0.4% to about 0.8% and when said Cr is about 1.8% to about 3.5%, said Mo is about 0.8% to about 1.2%, 0.10 to 0.53 wt.% Ni, 0.010 to 0.040 wt% soluble aluminum, at least one of 0.05 to 0.40 wt.% V and 0.02 to 0.20 wt.% Nb, less than 0.010 wt% Ti, 0.0002 to 0.0010 wt.% B, and less than 0.004 wt.% N, the balance of iron and impurities, the N and Ti satisfying the following equation $$N < 14/48 \times Ti + 0.0024\%;$$

rolling the heated steel to obtain a total reduction of more than 30% at a temperature above 1050° C. and finishing the rolling above or below 1050° C.;

directly quenching the rolled steel; and tempering the rolled steel.

2. The method according to claim 1 which further comprises finishing the rolling at temperature above the $Ar_3$ point.

3. The method according to claim 1 wherein said steel contains 0.8~1.8 wt.% of Cr and 0.4~0.8 wt.% of Mo.

4. The method according to claim 1 wherein said steel contains 1.8~2.5 wt.% of Cr and 0.8~1.2 wt.% of Mo.

5. The method according to claim 1 wherein said steel contains 2.5~3.5 wt.% of Cr and 0.8~1.2 wt.% of Mo.

6. The method according to claim 3, which further comprises finishing the rolling at temperature above the $Ar_3$ point.

7. The method according to claim 4, which further comprises finishing the rolling at temperature above the $Ar_3$ point.

8. The method according to claim 5, which further comprises finishing the rolling at temperature above the $Ar_3$ point.

* * * * *